US007059244B2

(12) United States Patent
Kobayashi et al.

(10) Patent No.: US 7,059,244 B2
(45) Date of Patent: Jun. 13, 2006

(54) METHOD FOR AQUEOUS GRAVURE PRINTING AND APPARATUS THEREFOR

(75) Inventors: Yukio Kobayashi, Tokyo (JP); Kaichiro Matsuki, deceased, late of Nabari (JP); by Chiyoko Matsuki, legal representative, Kyoto (JP); Takashi Ohara, Nabari (JP)

(73) Assignee: Nakamoto Packs Co., Ltd., Osaka (JP)

( * ) Notice: Subject to any disclaimer, the term of this patent is extended or adjusted under 35 U.S.C. 154(b) by 19 days.

(21) Appl. No.: 10/876,337

(22) Filed: Jun. 24, 2004

(65) Prior Publication Data

US 2004/0261637 A1 Dec. 30, 2004

(30) Foreign Application Priority Data

Jun. 26, 2003 (JP) ..... 2003-182777

(51) Int. Cl.

| | |
|---|---|
| ***B41F 23/04*** | (2006.01) |
| ***B41F 9/02*** | (2006.01) |
| ***B41F 9/06*** | (2006.01) |
| ***B41M 7/00*** | (2006.01) |

(52) U.S. Cl. ..... 101/152; 101/170; 101/424.1; 101/487; 101/488

(58) Field of Classification Search ..... 101/170, 101/487, 488

See application file for complete search history.

(56) References Cited

U.S. PATENT DOCUMENTS

| | | | | |
|---|---|---|---|---|
| 2,131,257 A | | 9/1938 | Risley, Jr. | |
| 3,733,711 A | * | 5/1973 | Haythornthwaite | 34/456 |
| 4,369,584 A | * | 1/1983 | Daane | 34/392 |

FOREIGN PATENT DOCUMENTS

| | | | |
|---|---|---|---|
| DE | 333953 | | 12/1958 |
| WO | 97/04962 | * | 2/1997 |

* cited by examiner

*Primary Examiner*—Daniel J. Colilla
(74) *Attorney, Agent, or Firm*—Flynn, Thiel, Boutell & Tanis, P.C.

(57) ABSTRACT

This invention provides a method for aqueous multicolor gravure printing which can print at a high speed without color drift, which is formed of plural printing unit processes, each of which contains a printing process, a drying process and a cooling process, wherein the quantity of heat supplied in the drying process in each printing unit is removed in the cooling process to render the temperature of the printed web uniform before the next printing process, and an apparatus therefor.

11 Claims, 4 Drawing Sheets

METHOD FOR AQUEOUS GRAVURE PRINTING AND APPARATUS THEREFOR

FIELD OF THE INVENTION is invention relates to a method for aqueous gravure printing, especially multicolor gravure printing characterized in a cooling process, and an apparatus therefor.

BACKGROUND OF THE INVENTION

Printing of packaging materials is carried out by gravure printing, offset printing, flexographic printing or the like and gravure printing is frequently used for packaging materials requiring a display effect on goods, because of excellent reproducibility up to fine portions of a design and gradation to produce photograph-like printing. The gravure printing process comprises placing oil ink on concaves on a drum surface engraved by conventional gravure, intaglio gravure, electronic photoengraving or the like, transferring the ink to raw web, and then, blowing hot air to evaporate the solvent of the ink to dryness. The oil ink is a dispersion of pigments in a vehicle produced by dissolving a resin, such as a polyurethane, acrylic resin, nitrocellulose or chlorinated polyolefin, into a solvent.

A conventional solvent is a mixture of toluene (40%)-ethyl acetate (40%)-isopropyl alcohol (20%), methyl ethyl ketone (40%)-ethyl acetate (40%)-isopropyl alcohol (20%) or the like. The solid content, i.e. resin and pigment, of the oil ink is, in common, 8–10%, and in the case of white solid ink requiring a shielding ability, those having a solid content up to 30% are used. In general, the temperature of the hot air is 55–60° C., and blowing volume is 30–70 $m^3$/min. Under these conditions, it is possible to set a printing speed at 120–200 m/min. In the multicolor printing, the number of colors employed is 2 to 10, and the greater the number of colors, the more the print becomes photograph-like decorative.

Packaging, materials frequently used for printing are films of polyethylene terephthalate (PET), oriented polypropylene (OPP), oriented nylon (O-NY), etc., and other applicable films are single layer films of polyethylene (PE), polypropylene (PP) polystyrene (PS), polyvinyl chloride (PVC), etc., shrinkable films of PET, PP, PS, PE, PVC, etc., and stretched films of PE, PVC, etc.

Recently, gravure printing is moving to an aqueous process using an aqueous ink, due to the problems of the solvent in the oil ink, noxious odors on the printing work, adverse effects on the health in the working atmosphere, possibility of explosion, residual solvent odor in prints, contamination of environment around a factory, reduction of $CO_2$ and spending of solvent resources because all the solvent is volatilized in the process of printing (Japanese Patent 3249223, JP 2001-030611A, JP 2002-096448A).

However, the solvent used in the aqueous ink is, e.g., water (70%)-ethanol (30%) having a latent heat of vaporization of 470.7 cal/g, which is great compared with the solvent of oil ink, e.g. 101.9 cal/g for toluene (40%)-ethyl acetate (40%)-isopropyl alcohol (20%) or 109.1 cal/g for methyl ethyl ketone (40%)-ethyl acetate (40%)-isopropyl alcohol (20%). That is, calories required for drying are as much as 4.3–4.6 times that of conventional oil inks. Properties of principal solvents used in gravure ink are summarized in Table 1.

TABLE 1

| Solvent | M.W. | b.p. (° C.) | Inflammation Point (closed) (° C.) | Vap. Latent Heat (b.p.) (KJ/kg) (cal/g) | Vapor Pressure (20° C.) (Pa) (mmHg) | Surface Tension (25° C.) (mN/m) (dyne/cm) | Solvility Parameter (Hansen) |
|---|---|---|---|---|---|---|---|
| Toluene | 92.1 | 110.6 | 4.4 | 363.6<br>86.9 | 4000<br>30.0 | 27.9<br>27.9 | 8.91 |
| Ethyl Acetate | 88.1 | 76.7 | −7.2 | 369<br>88.2 | 9706<br>72.8 | 23.8<br>23.8 | 9.10 |
| Methyl Ethyl Ketone | 72.1 | 79.6 | −4.0 | 439<br>105.2 | 9493<br>71.2 | 24.0<br>24.0 | 9.27 |
| Isopropanol | 60.1 | 82.3 | 11.7 | 666<br>159.2 | 4320<br>32.4 | 21.7<br>21.7* | 11.50 |
| n-propanol | 60.1 | 97.1 | 15.0 | 680<br>162.6 | 1933<br>14.5 | 23.8<br>23.8* | 11.97 |
| Ethanol | 46.7 | 78.3 | 16.0 | 833<br>199.2 | 7999<br>60.0 | 22.1<br>22.1 | 12.92 |
| Water | 18.0 | 100.0 | — | 2456<br>586.9 | 2333<br>17.5 | 71.8<br>71.8 | 23.50 |

*20° C.

A countermeasure is to raise the solids content of the aqueous ink by increasing the quantity of pigments within the range where the concentration of print is not changed, even using a small volume of aqueous ink. This has a limit up to an increase of 20% in the concentration of the oil ink. Thus, even when increasing the quantity of pigment, it is still necessary to supply 3.4–3.7 times the heat in the case of an oil ink, which requires the lengthening of the staying time in the drying process, increasing the blowing volume of the hot air and raising the temperature of the hot air, or the like.

However, lengthening the staying time is undesirable because of lowering the printing speed, and increasing the blowing volume degrades energy efficiency and causes flapping of raw web by the air. In view of heating efficiently, it is most suitable to raise the temperature of the hot air, but it results in raising the temperature of the raw web that includes slippages between printing pitches of each color caused by elongation of the web.

Temperature dependencies of the elongation (pitch elongation) of PET film, O-NY film and OPP film are shown in FIG. 3. The elongation of OPP film is the greatest, followed by O-NY film, and then PET film.

The slippage of printing pitches is rectified by reading color control marks in a form of a trapezoid (almost triangular) printed at an edge of a raw web by a scanning head, and when the distance (20.0 mm) from the trailing end of the base (10 mm) of the trapezoid mark to the front end of the next mark slips with a length of 0.2 mm or more, the length of the passage up to printing is aligned by moving automatically a compensator roll slightly.

However, when the elongation is great, deformation occurs caused by the elongation of the pattern printed in the previous printing unit (deformation of the pattern printed in the first printing unit is the greatest). As a result, color drift (slippage of printing) occurs between the previous print pattern and a pattern printed thereon, and it cannot be eliminated by the compensator roll.

By the way, PET film and O-NY film of which the elongation is small, can be printed at a printing speed of 120 m/min or higher at a temperature of the hot air for drying of 120° C. or higher, but OPP film, of which the elongation is great, cannot be printed due to the deformation of the patterns, which includes color drift (slippage of printing), although OPP film is cheap and widely used.

SUMMARY OF THE INVENTION

An object of the invention is to provide a method of aqueous multicolor gravure printing capable of printing a film, even an OPP film or a film having an elongation greater than OPP film, at a printing speed of 120 m/min, or more without color drift (slippage of printing) while the temperature of the hot air for drying is 120° C. or higher.

Another object of the invention is to provide an apparatus therefor.

The inventors investigated earnestly in order to achieve the above objects, and found that, in the printing-drying-cooling processes of the printing unit for each color of the aqueous multicolor gravure printing, when 3.5 times the heat quantity in the case of oil gravure printing is supplied in the drying process by raising the hot air temperature, the temperature of the raw web is raised due to insufficient cooling. Accordingly, heat gradually accumulates toward the second color printing, the third color printing, . . . to elevate the temperature of the raw web gradually. As a result, the elongation increases along the line (OPP-20 μm) in FIG. 3 (illustrating temperature dependency of elongation) to extend patterns (deformation) up to not allowable levels, and color drift (slippage of printing) occurs.

Then, the inventors further investigated in order to remove the above cause for color drift, and found that, even when the hot air temperature is raised to generate elongation, color drift problems can be solved by cooling it sufficiently in the cooling process to remove the heat quantity supplied in the printing unit. That is, when cooling the web so that the temperature of the web or printing of each color is almost uniform, the elongation of the web becomes almost the same on printing. Accordingly, patterns are not deformed and color drift does not occur.

The increase of the elongation with elevating temperatures is due to a decrease of elastic modulus in tension with elevating temperatures, and accordingly, the elongation of the film and elastic modulus in tension are in a relationship opposite to each other.

Temperature dependencies of elastic modulus in tension are shown in FIG. 4. As to the relationship between the elongation (tension: 8 kg/800 mm width) and elastic modulus in tension at 30° C. of PET and OPP, as shown in FIGS. 3 and 4, the elongation of PET is about 0.15%, the elongation of OPP is about 0.45%, the elastic modulus in tension of PET is about 440 kgf/mm$^2$, and the elastic modulus in tension of OPP is about 150 kg/f/mm$^2$. Thus, the elongation ratio of OPP/PET is 0.45%/0.15%=3.0, and the elastic modulus in tension ratio of OPP/PET is 150 kgf/mm$^2$/440 kgf/mm$^2$=1/3, and accordingly, these factors are in a relationship opposite to each other.

As explained above, even a film elongation caused by the decrease of elastic modulus in tension with an elevated temperature, when the film is cooled to the original temperature in a cooling process, the elastic modulus in tension returns to the original value, and the elongated film returns to the original state.

In the case of OPP film (20 μm), when a pattern having a size of 5 cm slips by 0.2 mm or more, color drift can be recognized. Thus, differences in elongation on printing each color can be allowed up to 0.4% (0.2/50×100). When the printing temperature of the first color (temperature of raw web on printing) is 25° C., since the elongation at 25° C. can be found about 0.3% from the full line (OPP-20 μm) in FIG. 3, the elongation allowance for not recognizing color drift can be estimated to be up to 0.7%, which is obtained by adding the above 0.4% to 0.3%. The elongation of 0.7% occurs at about 43° C., which can be found in FIG. 3. Thus, it can be seen that color drift to be recognized does not occur by cooling the raw web to 43° C. or lower on each printing.

Moreover, the inventors also found that, since conventional cooling is conducted to the surface to be printed, i.e. to one side, of the raw web by cooling air and a chilling roll in a moment, the cooling is insufficient due to residual heat remaining on the opposite side which spreads over by heat transfer after that. Then, they devised to apply a liquid to the opposite surface in addition to the cooling by means of cooling air and the chilling roll, and cooling by latent heat of vaporization by blowing cooling air. They found this means is very effective.

The present invention has been completed based on these findings, and provides;

A method for aqueous multicolor gravure printing which is formed of plural printing unit processes, each of which comprises a printing process, a drying process and a cooling process, wherein the quantity of heat supplied in the drying process in each printing unit is removed in the cooling process to render the temperature of the printed web uniform before the next printing process.

In the method for aqueous gravure printing of the invention, since the raw web is cooled so that the temperature of the raw web becomes almost the same on the printing in each printing unit, the elongation of the raw web also becomes almost the same on the printing of each color, and the differences in the elongations are almost non-existent. Accordingly, slippage of printing does not occur. Moreover, the rate of the elongation is made small by the cooling.

The apparatus for aqueous multicolor gravure printing of the invention has plural printing units, each of which comprises a printing portion, a drying portion and a cooling portion, wherein the cooling portion comprises a cooling roll around which a raw web is wound with the printed surface facing toward the surface of the roll, a blower blowing cooling air on the printed surface, an applicator applying a liquid for cooling to the surface opposite to the printed surface, and another blower blowing air on the opposite surface for accelerating the vaporization of the liquid for cooling from the opposite surface.

In the apparatus of the invention, the opposite surface of the raw web is cooled by the air blown from another blower to evaporate the liquid for cooling applied by the applicator, as well as the printed surface is cooled by the cooling roll and a blower. Accordingly, the raw web is cooled efficiently. Moreover, since the liquid for cooling applied by the applicator evaporates gradually, cooling continues for a considerable period.

Figure 1:
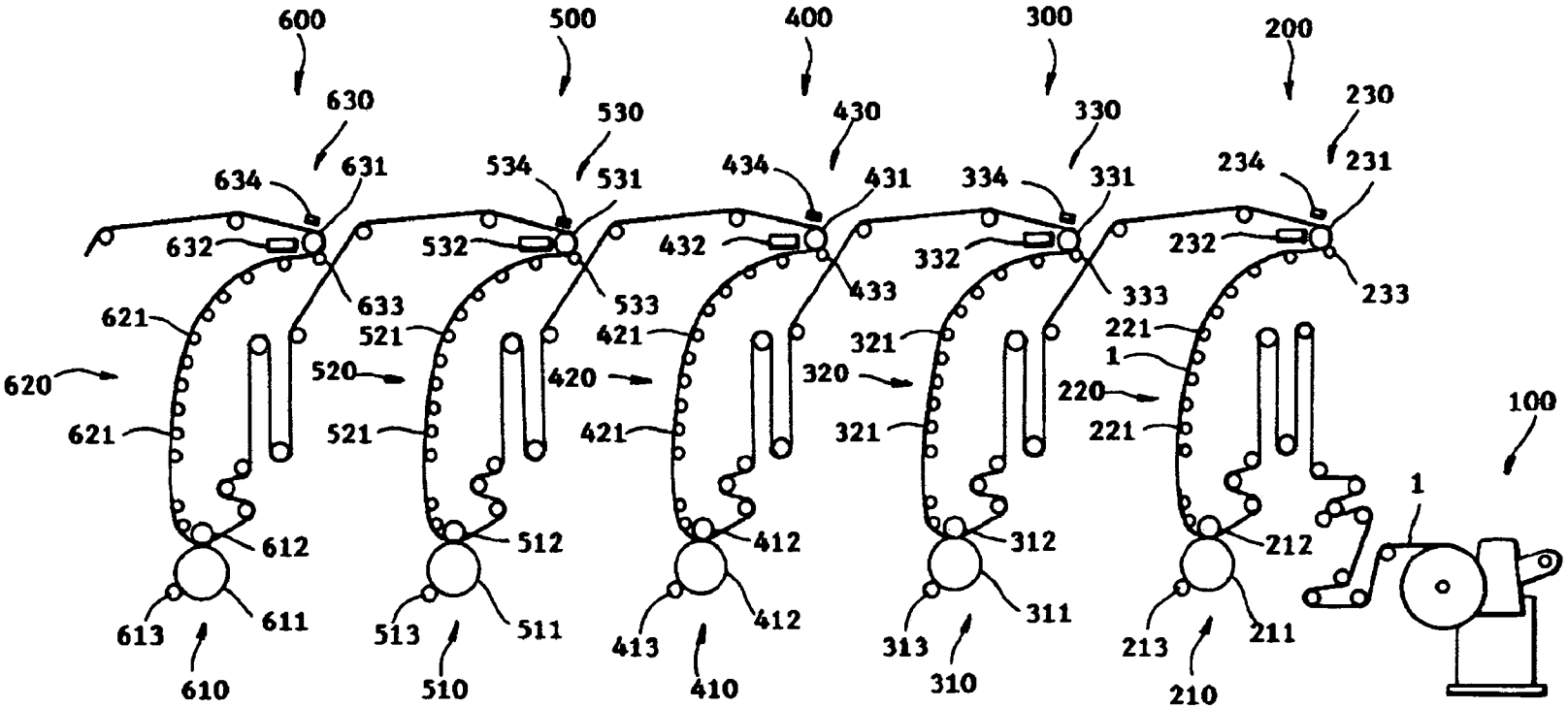
FIG. 1 is a diagrammatic illustration of an apparatus embodying the invention.

1 . . . Raw web
11 . . . Printed surface
12 . . . Liquid-applied surface
100 . . . Feeder
200 . . . First printing unit
210 . . . Printing portion
211 . . . Plate cylinder
212 . . . Impression cylinder
213 . . . Furnisher roll
220 . . . Drying portion
221 . . . Roller
230 . . . Cooling portion
231 . . . Cooling roll
232 . . . Cooling air blower
233 . . . Molleton roll
234 . . . Cooling air nozzle
300 . . . Second printing unit
400 . . . Third printing unit
500 . . . Fourth printing unit
600 . . . Fifth printing unit

DETAILED DESCRIPTION OF THE INVENTION

In the method for aqueous multicolor gravure printing of the invention, the raw web is cooled in the cooling process so that the temperature of the web becomes uniform during printing in each printing unit process. The means for cooling the web is not especially restricted so far as the temperature of the web can be made almost the same as that in the previous printing process.

The web may be cooled only from the printed surface side, but it is preferable to be cooled also from the opposite surface. By cooling the web from both sides, cooling can be conducted efficiently, and the temperature of the web can be lowered to a prescribed value without lowering the printing speed in the next printing process.

A cooling means of both sides of the web is to cool the printed surface by cooling air and a cooling roll, and to cool the opposite surface by applying a liquid for cooling followed by blowing cooling air to utilize latent heat of vaporization. By utilizing the vaporization of the liquid for cooling, cooling can be conducted efficiently through a simple structure. The cooling roll and blowing means of the cooling air may be conventional.

The liquid for cooling removes heat by the latent heat of vaporization, and is required to have a great latent heat of vaporization, to have a low boiling point and a high vapor pressure to be easily vaporized, and to have a small surface tension in order to apply it uniformly. The liquid for cooling may be a single liquid or a mixture of two or more types. For example, it may be a lower alcohol having 1 to 4 carbon atoms, such as methanol or ethanol. However, in the case of increasing the latent heat of vaporization, a liquid mixture containing water as the principal component is preferable, because water has a great latent heat of vaporization. A preferable liquid to be mixed with water is water-miscible and compensates for vaporization ability and low surface tension which are deficient in water.

Examples of the preferable liquid to be mixed with water are lower alcohols having 1 to 4 carbon atoms, esters, such as ethyl acetate, and ketones such as acetone, preferably, lower alcohols because of their having a great latent heat of vaporization and vapor pressure, and methanol and ethanol, especially methanol being the most preferred. Boiling point, latent heat of vaporization (evaporation), vapor pressure and surface tension of water, methanol, ethanol and ethyl acetate are summarized in Table 2.

TABLE 2

| | Item | | | |
|---|---|---|---|---|
| Liquid | b.p | Latent Heat of Vap. | Vap. Pressure (at 20° C.) | Surface Tension (at 25° C.) |
| Water | 100□ | 2456 KJ/kg<br>587 cal/g | 2333 Pa<br>17.5 mmHg | 71.8 mN/m<br>71.8 dyne/cm |
| Methanol | 64.6 | 1087<br>260 | 13332<br>100 | |
| Ethanol | 78.3 | 832<br>199 | 7999<br>60 | 22.1<br>22.1 |
| Ethyl Acetate | 76.7 | 368<br>88 | 9732<br>73 | 23.8<br>23.8 |

Properties of the liquid mixture fall between those of water and methanol, ethanol or ethyl acetate, except for the vapor pressure. Since each component evaporates separately, the vapor pressure is the sum of both components. With respect to the mixing ratio, increasing the water ratio increases the latent heat of vaporization but degrades the vaporizability. On the other hand, when the ratio of methanol, ethanol or ethyl acetate increases, although the vaporizability is improved, the latent heat of vaporization becomes small. A suitable mixing ratio can be selected from the range of 10:90 to 90:10 by water:organic solvent ratio by volume, particularly 30:70 to 90:10 by considering the vaporization rate and required latent heat of vaporization.

The application of the liquid for cooling may be conducted by any means capable of applying it almost uniformly, such as spraying or roll coater. A preferable means is to use a molleton roll (a metal roll around which a raised cloth, such as flannel cloth, is wound), in the cloth of which the liquid for cooling is immersed and then contacted with the raw web on the cooling roll, because it can be applied uniformly with a simple apparatus.

To the surface applied with the liquid for cooling, cooling air blows to accelerate the evaporation of the liquid. That is, since the vapor of the liquid for cooling is removed from the vapor phase around the surface applied with the liquid, the evaporation is accelerated. Even if the applied liquid for cooling remains to a certain degree, the remaining liquid evaporates on the subsequent traveling line to cool the web, and the evaporation is finished prior to the next printing. As a result, the temperature of the web is lowered to that of the printing in the previous printing process.

The more the web is cooled, the smaller the elongation is. Accordingly, more cooling is more effective. However, in the invention, it is important to make uniform the temperature of the web on the printing of each color from the first color to the last color.

Figure 3:
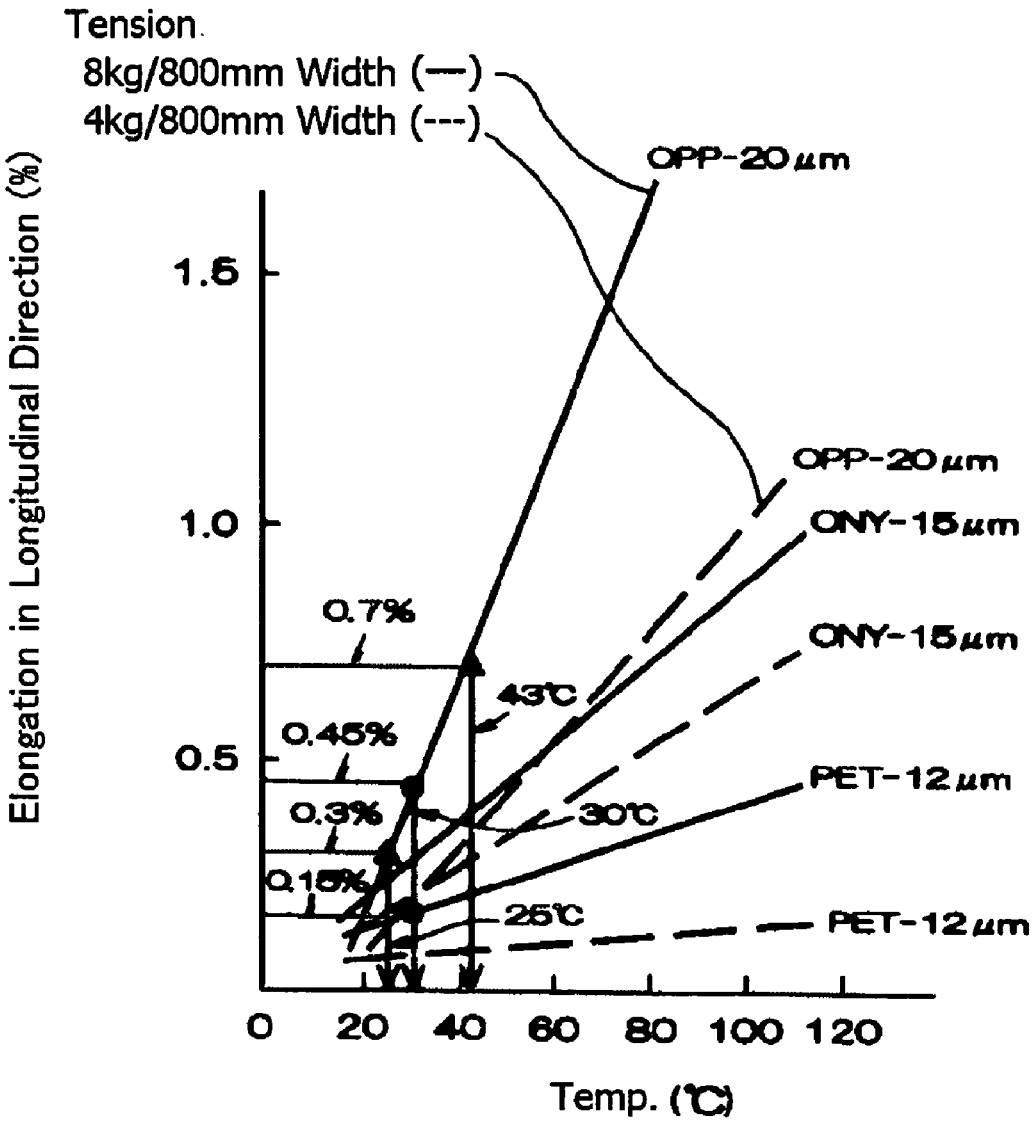
FIG. 3 is a graph showing the temperature dependency of elongation (pitch elongation) of various films.
Figure 4:
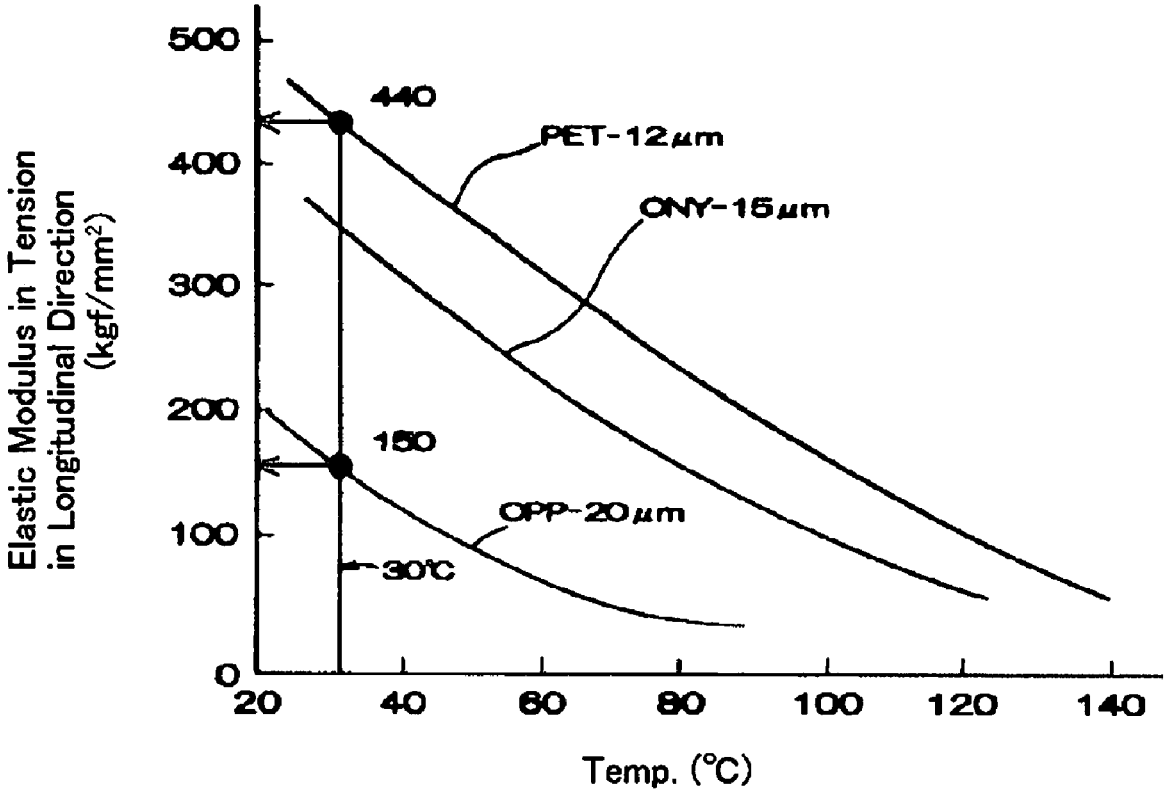
FIG. 4 is a graph showing the temperature dependency of elastic modulus in the tension of various films.

The degree of uniformity of the temperature required in the invention is set in the range of not recognizing color drift. The inventors confirmed that when slippage between each prints becomes 0.2 mm or more, color drift is recognized. Accordingly, the degree of uniformity of the temperature (allowable temperature variation) of the web on entering each printing is decided so that the elongation difference of the web between each printing becomes within 0.2 mm. Preferable slippage of printing is less than 0.15 mm, more preferably less than 0.1 mm. The slippage is the distance between the center or the same edge of a figure, such as a line. The allowable temperature variation can be set by measuring the relationship between elongation and temperature, as shown in FIG. 3, for each web.

The webs applicable to the invention are OPP film, films having an elongation smaller than OPP film, such as PET film and O-NY film, of which the printing speed can be raised, films liable to elongate more than OPP film, such as single layer films of PE, PP, PS and PVC, shrinkable films of PET, PE, PS and PVC, and stretched films of PE and PVC. The invention is particularly effective against the films liable to elongate more than OPP film, such as single layer films of PE, PP, PS and PVC, shrinkable films of PET, PE, PS and PVC, and stretched films of PE and PVC. The thickness of the films are, in general, in the range of 5 to 100 μm, particularly 7 to 50 μm.

An embodiment of the apparatus of the invention will be explained with reference to drawings.

Figure 2:
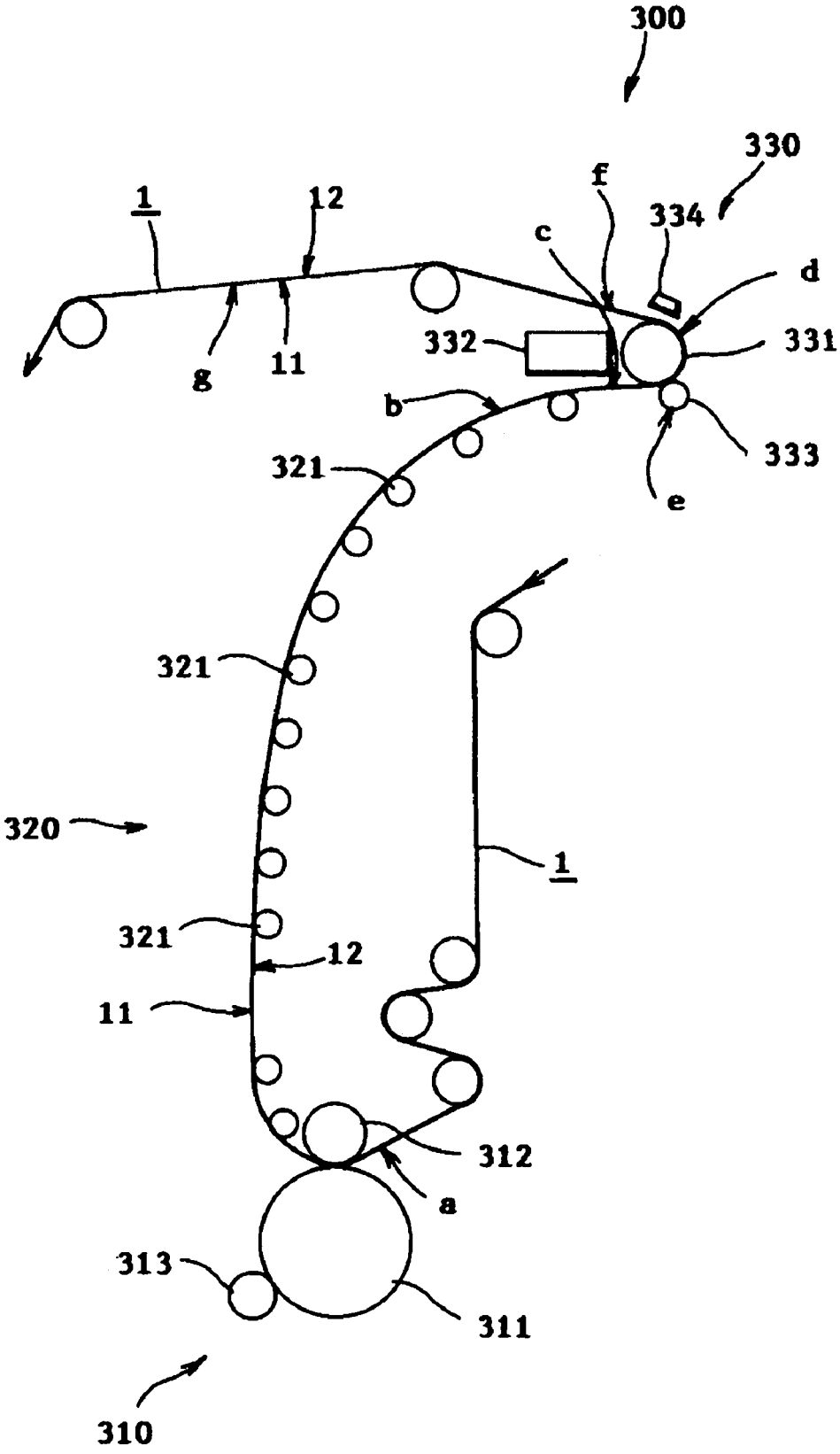
FIG. 2 is an enlarged partial view thereof.

FIG. 1 is a general view illustrating the diagrammatic configuration of the apparatus for aqueous multicolor gravure printing, and FIG. 2 is an enlarged partial view at the first printing unit portion.

The apparatus has a feeder 100 and five printing units, i.e. the first printing unit 200 printing a first color, the second printing unit 300 printing a second color, the third printing unit 400 printing a third color, the fourth printing unit 500 printing a fourth color, and the fifth printing unit 600 printing a fifth color.

The first printing unit 200 comprises a printing portion 210 where the first color is printed on the raw web 1, a drying portion 220 where the printing web 1 is dried, and a cooling portion 230 where the dried web 1 is cooled.

The printing portion 210 is provided with a plate cylinder 211, an impression cylinder 212 and a furnisher roll 213. The drying portion 220 is provided with many rollers 221, . . . , 221.

The cooling portion 230 is provided with a cooling roll 231 which contacts and cools the printed surface of the web 1, and cooling air blowers 232 which blow cooling air on the printed surface 11 of the web 1 on the upstream side in the vicinity of the cooling roll 231. A molleton roll 223 is provided in contact with the cooling roll 231, and a liquid for cooling is incorporated into the cloth material provided on the surface of the molleton roll 233. Further, cooling air nozzles 234 are arranged on the exit side of the cooling roll 231 as the blower for accelerating vaporization of the liquid for cooling. The cooling air nozzles 234 and the cooling air blowers 232 are connected to a supply source (not illustrated), and blows cooling air on the printed surface and the applied surface of the web 1, respectively.

The constructions of the downstream side printing units, i.e. the second printing unit 300 for the second color, the third printing unit 400 for the third color, the fourth printing unit 500 for the fourth color and the fifth printing unit 600 for the fifth color are similar to the first printing unit 200, each having a plate cylinder 311, 411, 511, 611, an impression cylinder 312, 412, 512, 612, a furnisher roll 313, 413, 513, 613, a roller 321, 421, 521, 621, a cooling roll 331, 431, 531, 631, cooling air blowers 332, 432, 532, 632, a molleton roll 333, 433, 533, 633 and cooling air nozzles 334, 434, 534, 634.

Using the above apparatus for aqueous multicolor gravure printing, the gravure printing is carried out by delivering the raw web 1 from the feeder 100 to the first printing unit 200. In the first printing unit 200, a first color (e.g. solid white) is printed on the web 1 at the printing portion 210 while pressing between the plate cylinder 211 and the compression cylinder 212. Then, the web 1 is dried by hot air at the drying portion 220, and delivered to the cooling portion 230.

At the cooling portion 230, the web 1 is cooled by blowing cooling air from the cooling air blowers 232 toward the printed surface 11, and then, cooled from the printed surface by passing the cooling roll 231. While passing the cooling roll 231, since the molleton roll 233 is contacted with the web 1 with pressure, the liquid for cooling impregnated into the molleton roll 233 is applied to the opposite surface of the web 1. Further, cooling air is blown from the cooling air nozzles 234 to the liquid-applied surface 12 on the exit side of the cooling roll 231. The liquid for cooling which vaporizes easily evaporates to remove heat from the web 1 by the latent heat of vaporization. By the cooling air blown from the cooling air nozzles 234, evaporated liquid for cooling is removed from surrounding of the web 1, and accordingly, the evaporation of the liquid cooling is accelerated.

Thus, the printed surface 11 side of the web 1 is cooled mainly by the cooling air from the cooling air blower 232 and the cooling roll 231, and the liquid-applied surface 12 side of the web 1 is cooled mainly by the latent heat of vaporization of the liquid for cooling, resulting in cooling the web efficiently as a whole. By the cooling, the temperature of the web 1 printed at the printing portion 210 is returned to almost the same temperature as entering therein.

In the second and thereafter printing units, similar motions are repeated to add an aqueous gravure printing composed of 5 colors to the web 1 to complete the gravure printing.

In each printing unit of the invention, the heat quantity supplied in the drying process is removed rapidly by cooling in the subsequent cooling process, and in the cooling process, the web is cooled so that the temperature of the web becomes almost the same as that when printing each color. Accordingly, even when the temperature of the web is elevated in the drying process, the temperature of the web is lowered on the next printing, the difference in the elongation of the web can be made small in each printing process. Moreover, the elongation itself of the web is also made small. Accordingly, even when the drying temperature is made high, slippage of printing between each color does not occur. It is particularly effective for OPP film which is liable to elongate by the heat, and films which are liable to elongate more than OPP film, such as single layer films of PE, PP, PS and PVC, shrinkable films of PET, PE, PP, PS and PVC, and stretched films of PE and PVC.

Moreover, in the invention, since the cooling portion is provided with a liquid for a cooling application means for applying a liquid for cooling on the surface opposite to the printed surface and a cooling air blowing means for blowing cooling air on the surface to which the liquid for cooling is applied, the web can be cooled efficiently by the latent heat of vaporization of the liquid for cooling. Thus, the heat supplied at the heating portion can be removed in the printing unit, and the temperature of the web in the next printing unit can be made close to that of the previous printing process.

EXAMPLE

Gravure rolls were used, each having a 1.0 mm square-lattice-shaped pattern carved on a plate cylinder by the electroengraving of helio-gravure (200 lines, 130°), and set in a five color gravure printing machine ("FM-5S type", Fuji Kikai Kabushiki Kaisha). Five type inks of solid white (solid content: 30% by weight), yellow (solid content: 12%), red (solid content: 12%), blue (solid content: 12%) and black (solid content: 12%) were prepared using aqueous inks ("Hydric PRP-401, Dainichi Seika Color & Chemicals Manufacturing Co., Ltd., which are dispersions of pigment in an acrylic resin vehicle) by diluting with water (70% by volume) and ethanol (30%).

A roll of OPP film (thickness: 20 μm, width: 1000 mm, length: 2000 m, corona treatment on one side, manufactured by Tocello Kabushiki Kaisha) was attached to the feeder 100 of the five color gravure printing machine as the raw web 1, and layer printing of the square lattice-shaped pattern was conducted on the corona-treated surface at a printing speed of 120 m/min with a tension of 8.0 Kg/1000 mm width in the order of white solid (the first printing unit 200), yellow (the second printing unit 300), red (the third printing unit 400), blue (the fourth printing unit 500) and black (the fifth printing unit 600), successively.

The hot air used in the drying portion 220, 320, 420, 520, 620 was at 120° C. at 60 $m^3$/min for the first printing unit 200 and at 100° C. at 60 $m^3$/min for the second and later printing units 300, 400, 500, 600.

At the cooling portion 230, 330, 430, 530, 630, cooling air at 30° C. was blown from the blowers already mounted 232, 332, 432, 532, 632 toward the printed surface 11 side, and then, the web passed the cooling roll 231, 331, 431, 531, 631 which had been also already mounted and cooled by passing cooling water at 30° C., to cool the printed surface 11.

Simultaneously, the opposite surface of the web was contacted with the molleton roll 233, 333, 433, 533, 633 of which the cloth had been impregnated with the liquid for cooling which was a mixture of water (70% by volume) and methanol (30%) to apply the liquid to the opposite surface. Subsequently, the cooling air at 30° C. was blown from the cooling air nozzles 234, 334, 434, 534, 634 at a blowing volume of 0.8 $m^3$/min on the liquid-applied surface 12 to cool it by evaporation of the liquid.

During printing, temperatures at the positions of a–g indicated in FIG. 2 were measured after 10 minutes from the start of printing to grasp the temperature behavior and to check that the temperature of the web became almost the same on the printing of each color from the first color to the fifth color. The temperature was measured by using a radiation thermometer.

The results are summarized in Table 3.

TABLE 3

| | Measured Position | | | | | | |
|---|---|---|---|---|---|---|---|
| Printing Unit | a | b | c | d | e | f | g |
| 1st Printing Unit | 25° C.* | 40° C. | 34° C. | 35° C. | 29° C. | 34° C. | 43° C. |
| 2nd Printing Unit | 33° C. | 47° C. | 42° C. | 34° C. | 26° C. | 35° C. | 42° C. |
| 3rd Printing Unit | 34° C. | 46° C. | 38° C. | 34° C. | 25° C. | 39° C. | 39° C. |
| 4th Printing Unit | 33° C. | 46° C. | 44° C. | 34° C. | 25° C. | 35° C. | 40° C. |
| 5th Printing Unit | 33° C. | 50° C. | 39° C. | 33° C. | 24° C. | 33° C. | 37° C. |

The measuring positions a through g are as indicated in FIG. 2, and details are as follows:

a: Temperature of the printed surface 11 of the web on entering the next printing unit, after finishing the cooling portion of the previous printing unit (the temperature of the raw web on printing in each unit)

b: Temperature of the printed surface 11 immediately after drying c: Temperature of the printed surface 11 after passing the cooling air blower d: Surface temperature of the cooling roll e: Surface temperature of the molleton roll f: Temperature of the liquid-applied surface immediately after passing the cooling nozzle g: Temperature of the printed surface 11 after passing the cooling nozzles

*: Storing temperature of the raw web (room temperature)

Subsequently, the temperature behavior is explained with respect to the second printing unit as an example.

After finishing the cooling portion of the first printing unit 200, the web 1 entered into the second printing unit 300. At that time, the web 1 had been cooled to 33° C. at position a, and was printed at this temperature. Then, the web 1 was dried, and the temperature of the web 1 immediately after the drying portion was raised to 47° C. at position b. At the cooling portion, the temperature of the printed surface 11 was lowered to 42° C. by blowing the cooling air (30° C.) at position c. The printed surface 11 was further cooled by the cooling roll 331 at 34° C., and while the liquid-applied surface 12 applied with the liquid for cooling by the molleton roll 333, followed by blowing the cooling air at 30° C. at 0.8 $m^3$/min from the cooling air nozzles 334. Then, the heat of the web 1 was removed by the latent heat of vaporization, and the temperature of the liquid-applied surface 12 was lowered to 35° C. at position f. On the other hand, the temperature of the printed surface was still 42° C. at position g, which indicates the presence of a temperature gradient. However, after finishing the cooling portion, the web entered into the third printing unit. At that time, the temperature of the printed surface 11 was lowered to 34° C. at position a. Accordingly, it is considered that cooling further proceeded by the latent heat of vaporization of the applied liquid for cooling. Like this, it is effective to cool the printed surface 11 by the cooling air and the cooling roll and to cool the opposite surface by applying the liquid for cooling and utilizing the latent heat of vaporization thereof, and particularly, the liquid for cooling exhibits continuous cooling by evaporation during the traveling of the web.

The temperatures of the web on printing were almost the same from the first color to the fifth color as shown in the column a of Table 3.

The layer prints of square lattice-shaped pattern printed in the order of solid white-yellow-red-blue-black were observed for a length of 2000 m by the naked eye to search the squeeze-out of color. The squeeze-out of color occurs caused by slippage of printing. As a result, it was found that the square lattice-shaped pattern was printed black in fine through the whole length, and the squeeze-out of color did not find, i.e. slippage of printing did not occur at all.

The invention claimed is:

1. A method for aqueous multicolor gravure printing which comprises the steps of:

providing plural printing unit stages, each of said stages comprising a printing process, a drying process and a cooling process and passing a web through the plural printing stages to provide a printed surface thereon, wherein the cooling process comprises a step of applying an aqueous cooling liquid to the surface of the web opposite to the printed surface and blowing cooling air toward the surface of the web opposite to the printed surface to accelerate the vaporization of the aqueous cooling liquid from the surface of the web opposite to the printed surface and heat supplied in the drying process is removed in the cooling process in each stage.

2. The method of claim 1, wherein the aqueous cooling liquid is a mixture of water and a water-miscible organic solvent.

3. The method of claim 2, wherein the water-miscible organic solvent is selected from the group consisting of a lower alcohol having 1 to 4 carbon atoms, ethyl acetate and acetone and the water:organic solvent ratio in the aqueous cooling liquid is 10:90–90:10 by volume.

4. The method of claim 3, wherein the organic solvent is methanol.

5. The method of claim 3, wherein the water organic solvent ratio is 30:70–90:10.

6. A method for aqueous multicolor gravure printing which comprises the steps of:

providing plural printing unit stages, each of said stages comprising a printing process, a drying process and a cooling process and passing a web through the plural printing stages to provide a printed surface thereon, wherein the cooling process comprises a step of applying an aqueous cooling liquid to the surface of the web opposite to the printed surface and blowing cooling air toward the surface of the web opposite to the printed surface to accelerate the vaporization of the aqueous cooling liquid from the surface of the web opposite to the printed surface and heat supplied in the drying process is removed in the cooling process in each stage to control the temperature of the web and maintain the web within an allowable elongation range and prevent color drift of the printing.

7. The method of claim 6, wherein the step of applying the aqueous cooling liquid is performed by spraying or through the use of a roll coater.

8. The method of claim 6, wherein the web is an OPP film or a film that will elongate more than the OPP film.

9. The method of claim 8, wherein the film that will elongate more than the OPP film is selected from the group consisting of a single layer film of polyethylene, polypropylene, polystyrene or polyvinyl chloride, a shrinkable film of polyethylene terephthalate, polyethylene, polystyrene or polyvinyl chloride and a stretched film of polyethylene or polyvinyl chloride.

10. The method of claim 6, wherein the web is an OPP film.

11. An apparatus for aqueous multicolor gravure printing which comprises plural printing unit stages for providing a printed surface on a web, each of said stages comprising a printing means, a drying means and a cooling means, the cooling means comprising a cooling roll around which the web is wound with the printed surface of the web facing the cooling roll, a first blower for blowing cooling air toward the printed surface of the web, an applicator for applying an aqueous cooling liquid to the surface of the web opposite to the printed surface and a second blower for blowing cooling air toward the surface of the web opposite to the printed surface to accelerate the vaporization of the aqueous cooling liquid from the surface of the web opposite to the printed surface.

* * * * *